US011126142B2

(12) United States Patent
Wahler et al.

(10) Patent No.: US 11,126,142 B2
(45) Date of Patent: Sep. 21, 2021

(54) WATCH CASE WITH INTERCHANGEABLE ROTATING BEZEL

(71) Applicant: Certina SA, Le Locle (CH)

(72) Inventors: Jean-Claude Wahler, Yverdon-les-Bains (CH); Philipp Tschumi, Niederwil (CH); Martial Bringolf, Le Landeron (CH)

(73) Assignee: Certina SA, Le Locle (CH)

( * ) Notice: Subject to any disclaimer, the term of this patent is extended or adjusted under 35 U.S.C. 154(b) by 444 days.

(21) Appl. No.: 16/227,330

(22) Filed: Dec. 20, 2018

(65) Prior Publication Data

US 2019/0187619 A1 Jun. 20, 2019

(30) Foreign Application Priority Data

Dec. 20, 2017 (EP) ..... 17208774

(51) Int. Cl.
*G04B 19/28* (2006.01)
*G04B 37/00* (2006.01)

(52) U.S. Cl.
CPC ..... *G04B 19/283* (2013.01); *G04B 19/286* (2013.01); *G04B 37/0041* (2013.01)

(58) Field of Classification Search
CPC .... G04B 19/286; G04B 19/283; G04B 19/28; G04B 37/0041
See application file for complete search history.

(56) References Cited

U.S. PATENT DOCUMENTS 2,989,838 A * 6/1961 Guggi ..... G04B 37/0008 368/292
3,386,239 A * 6/1968 Shiffman ..... G04B 37/225 368/296
5,319,617 A * 6/1994 Sonoda ..... G04B 19/286 368/294
5,490,123 A 2/1996 Biver
(Continued)

FOREIGN PATENT DOCUMENTS

EP 0 621 518 A1 10/1994
EP 1 662 342 A1 5/2006
(Continued)

OTHER PUBLICATIONS

European Search Report dated Jun. 5, 2018 in European application 17208774.4, filed on Dec. 20, 2017(with English Translation of Categories Cited).

*Primary Examiner* — Sean Kayes
(74) *Attorney, Agent, or Firm* — Oblon, McClelland, Maier & Neustadt, L.L.P.

(57) ABSTRACT

A watch case including a middle defining a peripheral track; a rotating bezel; a toothed crown; a structure for detachably fastening the bezel on the middle with the possibility of axial clearance, the fastening structure includes a band supporting radially projecting fins, each capable of engaging with a bayonet formed in the middle; a coupling system including a male part and a female part, one of which is integral with the bezel and the other one of which is integral with the fastening structure, with this coupling system being able to adopt a decoupling configuration, in which the male part and the female part are decoupled, and a coupling configuration, in which the male part and the female part are coupled.

20 Claims, 8 Drawing Sheets

(56) References Cited

U.S. PATENT DOCUMENTS

| | | | | |
|---|---|---|---|---|
| 6,821,014 | B2 * | 11/2004 | Hiranuma | G04B 19/286 368/294 |
| 2003/0123332 | A1 * | 7/2003 | Hiranuma | G04B 19/286 368/295 |
| 2006/0114753 | A1 | 6/2006 | Gerber | |
| 2015/0185702 | A1 | 7/2015 | Silvant | |

FOREIGN PATENT DOCUMENTS

| | | | |
|---|---|---|---|
| WO | WO 2007/105043 | A2 | 9/2007 |
| WO | WO 2013/182487 | A1 | 12/2013 |

* cited by examiner 19
17
15
16
14
20
18
21
SC,50
1
16

35
34
32
36
33
30
SC,51
31
31
35
33
36
35
34
31
34
SF
28
28
27
25
37
27
26
37
28
28
49
26
53
28
28
13
29
46
5
48
38
4
7
6
7
2
8
X
9
3
9
3
7
3

WATCH CASE WITH INTERCHANGEABLE ROTATING BEZEL

CROSS-REFERENCE TO RELATED APPLICATION

This application claims priority to European Patent Application No. 17208774.4 filed on Dec. 20, 2017, the entire disclosure of which is hereby incorporated herein by reference.

TECHNICAL FIELD

The invention relates to the field of horology. It more specifically relates to a watch case with a rotating bezel, as well as to a watch equipped with such a case.

TECHNOLOGICAL BACKGROUND

Watch cases with a rotating bezel are commonly intended to equip diving watches. However, they are suitable for numerous other activities, particularly sporting activities, that require timing.

The bezel, which generally rotates in one direction (most often anti-clockwise) is provided with a graduation, typically in tens or in quarters, and with a zero index (ordinarily in the form of a triangle, an apex of which points towards the centre of the watch).

In order to measure the elapsed time during a diving session (or any activity, particularly a sporting activity), the wearer rotates the bezel at the start of the session in order to align the index with the minute hand. As it runs, this then indicates, on a level with the graduation of the bezel, the time that has elapsed during the session.

Some models, which have become classic models, are well known to divers and enthusiasts: Blancpain Fifty Fathoms, Omega Seamaster, Certina Action Diver can be cited in particular. In order to provide unidirectional rotation of the bezel, watchmakers most often use a pawl mechanism.

It can be beneficial for a wearer to be able to easily replace the rotating bezel. Various reasons can be cited to this end: personalization of the watch, temporary adaptation of the watch for certain activities, particularly sporting activities (for example, scuba diving).

A watch case with an interchangeable rotating bezel has already been designed, see Swiss patent CH 703400, for example, which proposes a mechanism comprising, in addition to the rotating bezel and a knurled ring that is integral therewith, a spring washer, a toothed indexing ring, a retention ring provided with notches and undercuts and pawls in the form of radial pins that resiliently engage with the teeth of the toothed ring. During normal operation, the pins jump from one tooth to the next while being axially blocked by the notches of the retention ring, which thus form a bayonet for fastening the bezel. In order to disconnect the bezel, it must be positioned in an unstable angular position, in which the pins are each located at the apex of a tooth, then the undercuts of the retention ring need to be brought level with the teeth in order to axially release them.

This mechanism has a complex architecture and is delicate to use. The positioning of the bezel in its unstable angular position must be performed in an extremely precise manner, otherwise the pins tend to return to their normal operating position, in which they prevent the removal of the bezel. For a regular user, replacing the bezel themselves proves to be a difficult undertaking, especially in the middle of sporting activities. For this reason, it seems that this operation can only be successfully undertaken in a workshop. Furthermore, when the bezel is disassembled, the toothed indexing ring is no longer held on the middle and care must be taken to prevent it from being dropped or even lost.

Consequently, there is still a requirement for proposing a watch case with a detachable rotating bezel, the replacement of which is simple and quick, whilst allowing reliable assembly and locking of the rotating bezel, and this is a first aim of the present invention.

A second aim is, whilst meeting the first aim, to minimize the number of parts for retaining the bezel.

A third aim of the invention is to form a complete interchangeable block (integrating the bezel), the parts of which remain secured during disassembly. In particular, the invention proposes providing a solution in which no individual part, after disassembly of the bezel, is connected to the bezel or to the middle of the watch case, so as to prevent any loss or damage to such an individual part by a user of the relevant watch or a positioning error when reassembling a bezel on the middle.

SUMMARY OF THE INVENTION

In order to achieve all or some of the aforementioned aims, according to a first aim, a watch case is proposed comprising:

- a middle defining a peripheral track;
- a rotating bezel;
- a toothed crown;
- at least one angular indexing member that resiliently engages with the toothed crown to define a plurality of stable angular positions of the bezel relative to the middle;
- a structure for detachably fastening the bezel on the middle, which structure comprises a band supporting radially projecting fins, each capable of engaging with a bayonet formed in the middle, the bezel being mounted on the fastening structure with the possibility of axial clearance between a deployed position and a retracted position;
- a coupling system comprising a male part and a female part, one of which is integral with the bezel and the other one of which is integral with the fastening structure, with this coupling system being arranged to be able to adopt, depending on whether the bezel is in the deployed position or in the retracted position, two respective configurations:
- a decoupling configuration, in which the male part and the female part are decoupled, thus rotationally releasing the bezel relative to the band;
- a coupling configuration, in which the male part and the female part are coupled, thus rotationally securing the bezel and the band and enabling their combined bidirectional rotation between a closed angular position, in which each fin is engaged in a bayonet, and an open angular position, in which each fin is disengaged from the bayonet so as to release the bezel.

In its deployed position, the bezel is capable of rotating in order to be placed in any one of the positions of the plurality of stable angular positions. To disassemble the bezel, it must be placed in an angular position that allows it to be pressed in, then it needs to be pressed towards its retracted position so as to place the coupling system in the coupling configuration and, finally, the bezel needs to be rotated (which entrains the band) in order to disengage each fin from its respective bayonet. Consequently, the sub-assembly comprising the bezel and the fastening structure, assembled therewith, can be removed from the middle and replaced with another sub-assembly comprising a different bezel, with the fastening structure being able to be assembled with the replacement bezel or each bezel has its own fastening structure.

This procedure is particularly simple and can be undertaken by the wearer themselves, including in the field (rather than in a workshop). The watch case further comprises a limited number of parts, which simplifies its manufacture and enhances its reliability.

Various additional features can be provided, individually or in combination. Thus, for example:

- the fastening structure comprises a ring provided with a collar and at least one hook for fastening to the bezel in order to axially retain said bezel, and a lock ring integrating the aforementioned band and which is interposed between the bezel and the ring;
- the lock ring comprises at least one pawl spring that projects from an upper face of the band to form an angular indexing member engaging with the toothed crown;
- the crown is integrally formed with the indexing bezel;
- the male part of the coupling system is a pin integral with the bezel and which projects from a lower face thereof, and the female part is an opening formed in the band that is capable of, in a predetermined angular position of the bezel, receiving the pin in the retracted position of the bezel;

the pin is an added part press-fitted into a hole provided in the bezel and emerging on the side of its lower face;

- the opening is in the form of an oblong hole allowing a slight angular clearance in the bezel when the pin is housed therein;
- the or each bayonet comprises a groove provided in a rim of the middle, and a hollow, in which the groove tangentially emerges;
- each groove ends tangentially, opposite the hollow, with a blind end;
- the ring is provided with a cut and the lock ring is provided with a projecting claw, matching the cut and housed therein in order to rotationally secure the ring and the lock ring;
- the ring comprises a peripheral series of hooks for fastening to the bezel;
- the lock ring is provided with leaf springs that project from a lower face of the band in order to be applied against the annular track of the middle and thus urge the fins against an upper face of their respective bayonet;
- the lock ring is provided with at least one projecting catch adjacent to a fin that is capable of snap-fitting in the middle at a blind end of the bayonet in order to lock the lock ring and thus the band in its closed angular position;
- alternatively, the middle is provided with a resilient boss that projects from the track, and the ring is provided with a notch capable of snap-fitting on the boss in order to retain the ring and the lock ring in an angular position in which the fins are each engaged in their respective bayonet.

According to a second aim, a watch is proposed that is equipped with a watch case as described above.

Further aims and advantages of the invention will become apparent in light of the description of embodiments, which description is provided hereafter with reference to the drawings.

DETAILED DESCRIPTION OF THE INVENTION

Figure 1:
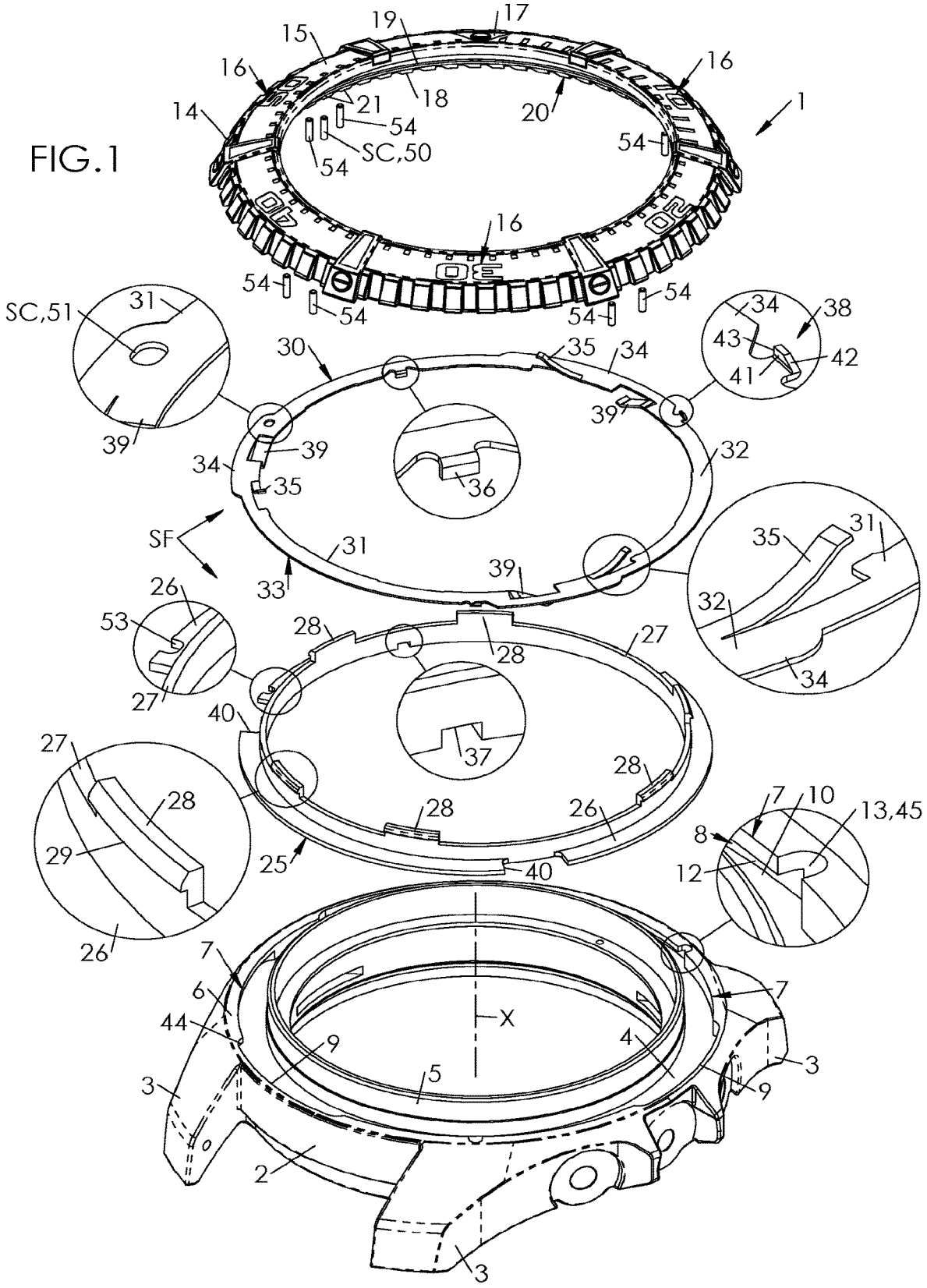
FIG. 1 is a partial exploded perspective top view of a watch case equipped with an interchangeable unidirectional rotating bezel, according to a first embodiment.

FIG. 1 shows a case 1 intended to equip a watch. In addition to the case 1, the watch comprises various components that are not shown: timepiece movement (mounted in the case 1), strap (hooked on the case), glass, bottom.

Firstly, the case 1 comprises a middle 2. The middle 2 can be made of metal (for example, of steel, preferably stainless steel), or of a synthetic material (for example, a composite material comprising a polymer matrix loaded with fibres, typically carbon). As can be seen in FIG. 1, the middle 2 has a circular profile. The middle 2 defines an internal space configured to receive the movement.

According to an embodiment shown in FIG. 1, the middle 2 comprises horns 3, on which the strap is intended to be hooked so that the watch can be worn on the wrist. If the horns 3 are ignored, the middle 2 exhibits general rotational symmetry about a central axis X.

The term "axial" denotes a general direction parallel to the central axis X. The term "transversal" or "horizontal" denotes a general orientation in a plane perpendicular to the central axis X. The term "radial" denotes a general direction along an axis perpendicular to and coincident with the central axis X. The term "tangential" denotes a general direction following a circle about the central axis X. The terms "top" and "bottom" are used according to their conventional definition, in a case 1 position in which it is placed flat, with the horns at the bottom.

The middle 2 defines a peripheral track 4. This track has a circular profile about the central axis X and extends in a transversal plane. The track is internally bordered by a socket 5 that extends axially by projecting from the track 4, and is externally bordered by a rim 6 that also extends axially by projecting from the track. The height of the rim 6, measured from the track, is below that of the socket 5 (also measured from the track).

Bayonets are formed in the middle 2. At least two bayonets are provided, diametrically opposed, for example. In the example shown, three bayonets 7 are provided (in this case distributed at 120° intervals about the central axis X). According to a preferred embodiment, each bayonet 7 comprises a groove 8 provided in the rim 6, and a hollow 9, in which the groove 8 tangentially emerges.

The groove 8 radially emerges inwardly, facing the socket 5. The groove 8 is delimited:

towards the bottom by a lower face 10, which extends in the extension of the track 4;

towards the top by an upper face 11, which extends facing the lower face 10; and radially towards the outside by an external wall 12 formed in the rim 6.

Each hollow 9 is, in the embodiment shown, in the form of a cut in the rim 6, which tangentially interrupts the upper face 11 of the groove 8.

The bayonet 7 terminates with a blind end 13. This blind end is located tangentially opposite the hollow 9 and closes the groove 8.

Secondly, the watch case 1 comprises a rotating bezel 14 detachably mounted on the middle 1. The bezel is in the form of an annular part. The bezel has an upper face 15, on which a graduation 16 is affixed or formed. In the example shown, the graduation comprises indexes, some of which are representational and are in the form of numerals (preferably Arabic numerals). One of the indexes, called zero index 17, is in the form of a triangle pointing towards the inside of the bezel 14, in order to form a home reference, from which the user measures, in minutes, the elapsed time from an initial predetermined instant corresponding to a precise angular position of the bezel relative to the middle 2.

Figure 7:
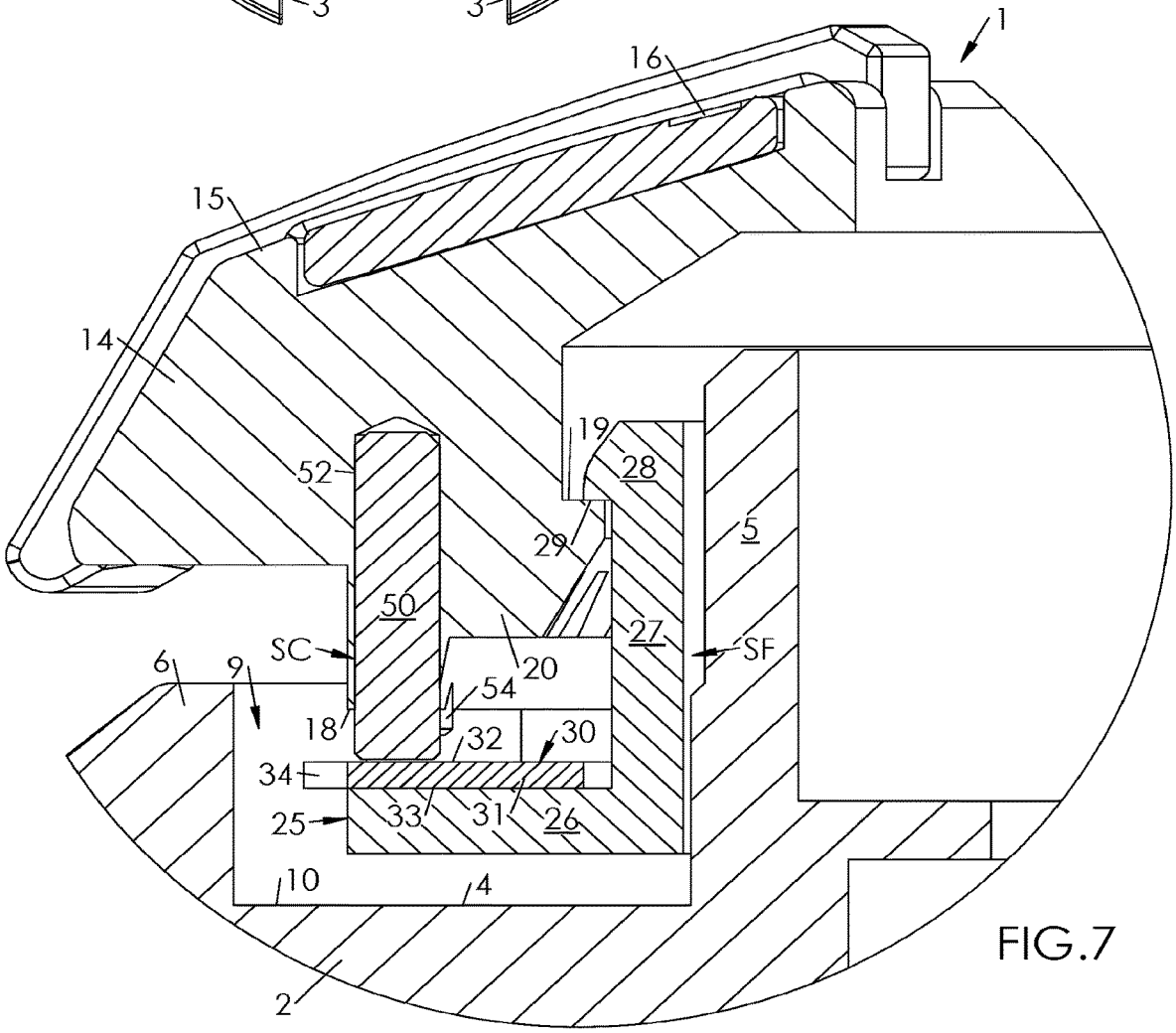
FIG. 7 is a detailed section view along the cutting plane VII-VII of FIG. 6.
Figure 9:
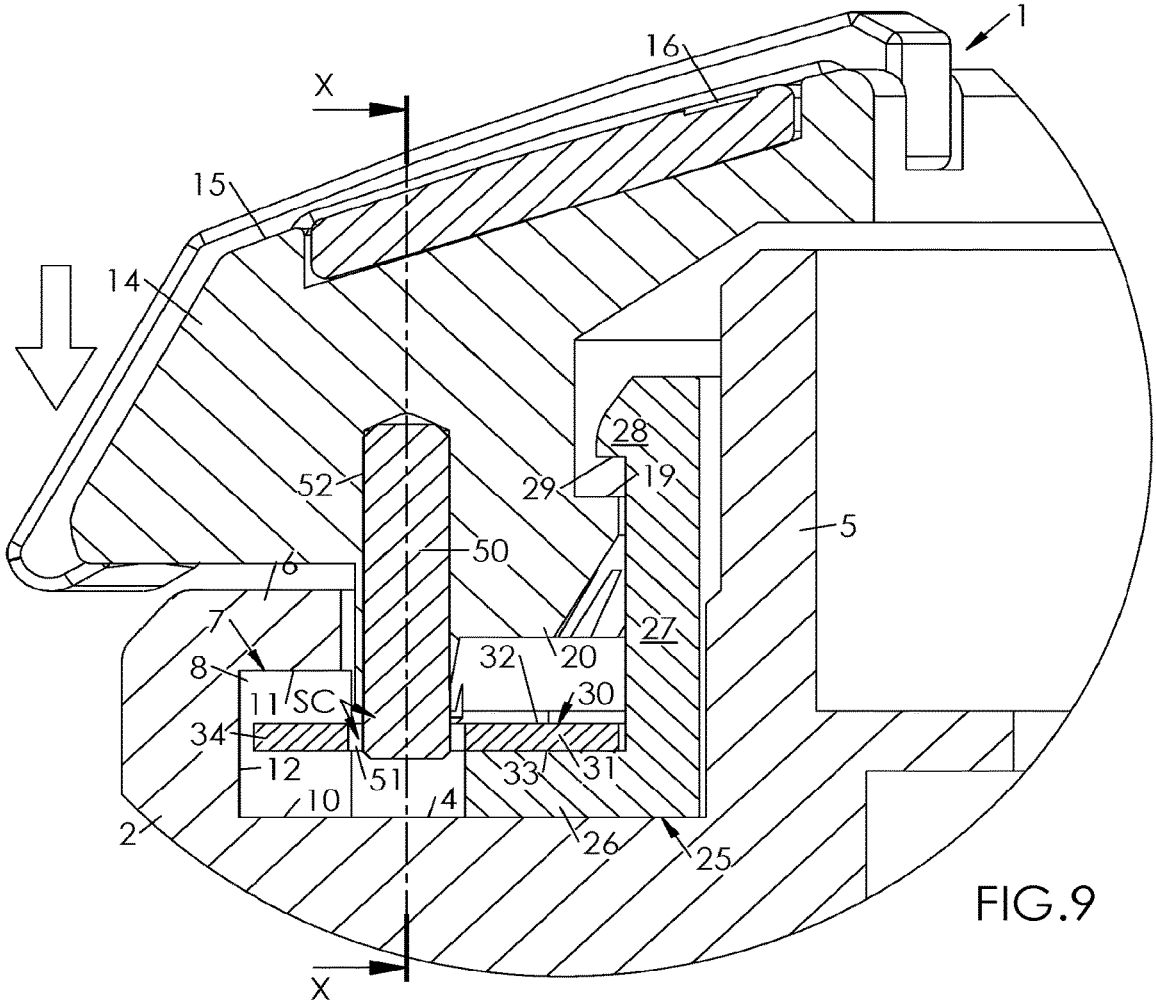
FIG. 9 is a section view along the plane IX-IX of FIG. 8.

The bezel 14 also has an opposite lower face 18, which extends facing the middle 2 and, more specifically, facing the track 4. As shown in FIG. 7 and FIG. 9, the bezel is provided with an annular rib 19 that radially projects inwardly. The bezel preferably is made of a metal material, for example, stainless steel.

Figure 4:
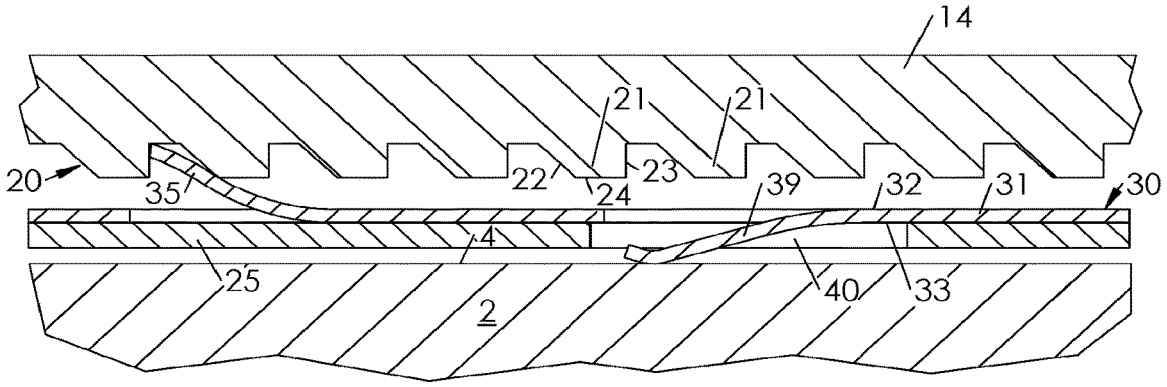
FIG. 4 is a partial section view along the broken cutting line IV-IV of FIG. 3.

Thirdly, the watch case 1 comprises a toothed crown 20. This toothed crown, which as will be seen is used for angular indexing of the bezel 14 relative to the middle 2, comprises a peripheral series of teeth 21, in this case sixty teeth. As shown in FIG. 4, each tooth 21 is asymmetrical and comprises an inclined ramp 22 and a vertical stop surface 23, optionally connected by a horizontal plate 24. According to a preferred embodiment, the toothed crown 20 is integrally formed with the bezel 14, i.e. they together form a single one-piece part.

As can be clearly seen in FIG. 2, the toothed crown 20 opens downwards, i.e. each tooth 21 projects towards the middle 2, on the side of the lower face 18 of the bezel 14, below the annular rib 19.

Fourthly, the case 1 comprises a structure SF for detachably fastening the bezel 14 on the middle 2. In the examples shown, the fastening structure SF firstly comprises a ring 25. This ring is provided with an annular collar 26. The collar 26 transversely extends level with the track 4.

Figure 11:
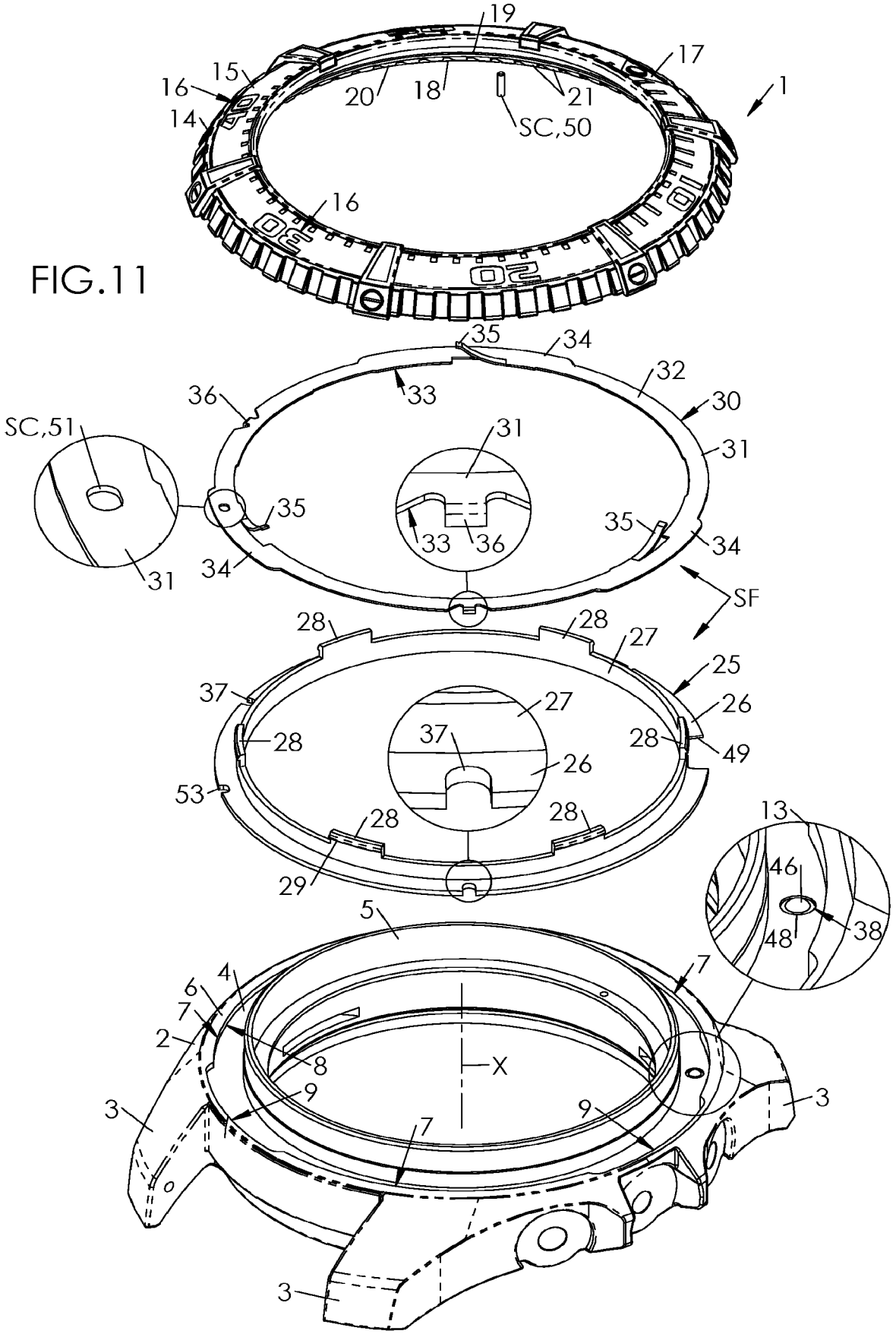
FIG. 11 is a partial exploded perspective top view of a watch case equipped with an interchangeable unidirectional rotating bezel, according to a second embodiment.

In the embodiments shown, see FIG. 1 and FIG. 11 in particular, the ring 25 also comprises a cylindrical skirt 27 that axially projects from an internal edge of the collar 26, such that a transversal section of the ring has an L-shaped profile (or a square profile).

The ring 25 comprises at least one hook 28 (in this case in the form of a notched resilient tab) for fastening to the bezel 14. Preferably, the ring 25 comprises a peripheral series of hooks 28, evenly (or otherwise) distributed over the periphery of the ring 25. The (or each) hook axially projects. In the examples shown (FIG. 1, FIG. 11), the (or each) hook 28 axially projects from an upper edge of the skirt 27.

As can be particularly seen in FIG. 7 and FIG. 9, each hook 28 has, on an upper edge, a notch 29, by which the hook 28 is engaged with the annular rib 19 of the bezel 14. It is by snap-fitting the notch 29 on the rib that the ring 25 is hooked on the bezel 14, on the side of the lower face 18 thereof. The ring is mounted on the middle 2 by engaging the skirt 27 on the socket 5 (FIG. 7 and FIG. 9).

The collar 26 has an external diameter that it is smaller than the internal diameter of the rim 6 of the middle 2, measured level with the socket 5. In this way, the collar can be freely engaged on the middle 2 or can be freely removed therefrom.

As will be seen hereafter, in the normal operating position, the collar 26 is not necessarily in contact with the track 4, but is slightly separated therefrom.

The ring 25 preferably is made of a metal material (for example, of steel). However, it can be made of a plastic material (advantageously an extremely hard material, for example, polyoxymethylene or POM).

In the examples shown, the fastening structure SF secondly comprises a lock ring 30 interposed between the bezel 14 and the ring 25. This lock ring is rotationally integral with the ring.

The lock ring 30 comprises a band 31. This band transversely extends in a circular manner about the axis X and in line with the collar 26 of the ring 25. The band 31 has an upper face 32, facing the lower face 18 of the bezel, and has an opposite lower face 33, facing the collar 26 of the ring. The band 31 has fins 34 that radially project (towards the outside), each of which is capable of detachably engaging in a bayonet 7.

The overall diameter of the lock ring 30, measured at the fins 34, is greater than the internal diameter of the rim 6 of the middle 2, measured level with the bayonet 7.

In the examples shown, the lock ring 30 is mounted on the ring 25 by being engaged on the skirt 27. To this end, the internal diameter of the lock ring 30 is greater than the external diameter of the skirt 27. In order to allow the lock ring to be engaged despite the presence of the hooks 28, the notches 29 of which form radial projections, the internal edge of the band 31 can be splined level with the hooks.

The lock ring 30 further comprises at least one pawl spring 35, which projects from the upper face 32 of the band 31 to form an angular indexing member of the bezel 14. The pawl spring 35 resiliently engages with the toothed crown 20 in order to define a plurality of stable angular positions (as many positions as there are teeth 21, accordingly sixty in this case) of the bezel 14 relative to the middle 2. Advantageously, at least two pawl springs are provided. In the embodiments shown, the lock ring 30 comprises three pawl springs 35. In this case, the springs are distributed so as to balance the forces, typically at 120° intervals about the axis X.

Each spring 35 is preferably integrally formed (i.e. a single part) with the band 31. Thus, in the embodiments of FIG. 1 and FIG. 11, each spring is formed by a strip cut into an internal edge of the band, then pushed upwards.

The lock ring 30 preferably is entirely manufactured from spring steel, and is shaped by stamping, for example.

The lock ring 30 is mounted on the ring 25. As shown in FIG. 7, the band 31 is axially wedged in abutment against the collar 26.

As shown in FIG. 1 and FIG. 11, the lock ring 30 further comprises at least one claw 36, which projects from the lower face 33 of the band 31 and which engages with a matching cut 37 provided facing it in the ring 25 (and, more specifically, in the collar 26).

Preferably, the lock ring 30 comprises, in order to distribute the forces, a plurality of claws 36 (three in the embodiment of FIG. 1; two in the embodiment of FIG. 11), whereas the ring 25 comprises a plurality of corresponding cuts 37 (three in the embodiment of FIG. 1; two in the embodiment of FIG. 11).

When the lock ring 30 is mounted on the ring 25, each claw 36 is housed in the corresponding cut 37. This results in the rotational securing of the lock ring and the ring.

The lock ring 30 ensures axial blocking of the ring 25 (and therefore of the bezel 14 that is hooked thereto) relative to the middle 2, by means of a bayonet system comprising:

fins 34 on the lock ring 30;

bayonets 7 on the middle 2, into which bayonets the fins 34 are introduced.

The lock ring 30 is fastened on the middle 2 by a combined movement comprising an axial translation movement, during which the fins 34 are introduced into the hollows 9, followed by a rotation movement about the axis X, during which each fin 34 is tangentially introduced into a groove 8. Once this combined movement is complete, the ring 25 is held captive between the lock ring and the middle 2. More specifically, even though the skirt 27 of the ring 25 is engaged on the socket 5 of the middle, its collar 26 is axially held captive between the lock ring 30 and the track 4.

The blind end 13 of at least one of the grooves 8 forms an angular travel limit stop for the rotation of the lock ring 30.

The watch case 1 advantageously comprises a mechanism 38 for locking the lock ring 30 relative to the middle 2, at the end of angular travel position of the lock ring during its assembly.

According to a first embodiment shown in FIG. 1 to FIG. 9, the lock ring 30 is provided with leaf springs 39 (in this case three disposed at 120° intervals about the axis X for uniform distribution of the forces), which project from the lower face 33 of the band in order to be applied against the annular track 4 of the middle 2, to axially constrain the lock ring upwards and thus urge the fins 34 against the upper face 11 of the groove 8 of their respective bayonet 7. In order to allow free passage (and free bending) of the leaf springs 39, the ring 25 is provided, in line with each spring, with a slot 40 provided in the collar 26.

In this embodiment, the locking mechanism 38 comprises at least one catch 41 formed so as to project on the lock ring 30, adjacent to a fin 34, and capable of snap-fitting in a recess of the middle 2 at the blind end 13 of the bayonet 7. It is to be noted that each catch and the recess associated therewith can be provided at other locations, for example, each catch is placed along a respective fin and the recess is arranged in the middle of the corresponding groove of the relevant bayonet. In order to facilitate the assembly of the bezel, it is understood that it is preferable for each fin and for each corresponding bayonet to be provided with the same locking mechanism, so that a specific fin is not dedicated to a single given bayonet.

Figure 5:
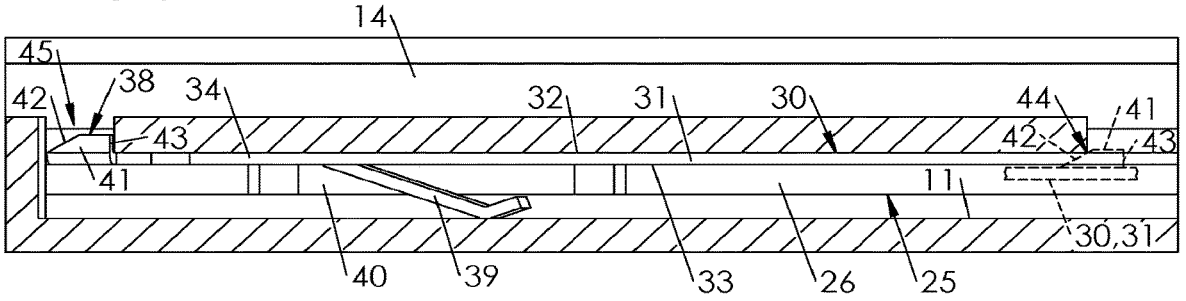
FIG. 5 is a partial section view along the broken cutting line V-V of FIG. 3.
Figure 6:
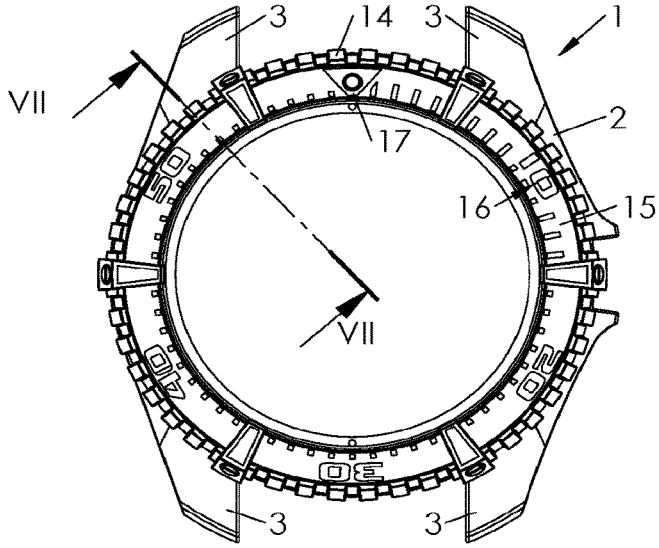
FIG. 6 is a top plan view showing the assembled watch case, with its bezel in an angular position where the zero index is at twelve o'clock.

As shown in FIG. 5, the catch 41 comprises a chamfered front edge 42 and a straight rear edge 43. During the combined movement of fastening the lock ring 30 on the middle 2, the axial translation movement is completed against the return force of the leaf springs 39, which tends to axially separate the lock ring from the track 4.

The rotation about the axis X brings the chamfered front edge 42 of the catch 41 against an edge 44 limiting the upper face 11 of the groove 8, on the side of the hollow 9. As the rotation force of the lock ring 30 continues, the chamfered front edge 42 slides on the edge, which compresses the leaf springs 39 and forces the fin 34 to pass under the upper face 11 of the groove 8, while allowing the rotation of the lock ring 30 to continue up to the angular travel limit stop.

In the example shown in FIG. 5, the blind end 13 of the bayonet 7 is provided with an indentation 45, into which the catch 41 is snap-fitted at the end of travel position, by deployment of the leaf springs 39. The lock ring 30 is then urged against the upper face 11 of the groove 8 by the return force of the leaf springs and it is rotationally locked in this closed position.

Simultaneously, the pawl springs 35 exert an axial force on the crown 20 (and therefore on the bezel 14) that tends to separate the bezel 14 from the middle 2. As the ring 25 is hooked on the bezel, the ring is axially stressed until it is urged against the lower face 33 of the band 31, which explains the configuration shown in FIG. 7 (in which, given the position of the cutting plane, the bayonet 7 cannot be seen, but it is nevertheless visible in FIG. 9).

According to a second embodiment shown in FIG. 11 to FIG. 14, the mechanism 38 for locking the lock ring 30 relative to the middle 2 comprises:

a resilient boss 46 provided on the middle 2 and projecting from the track 4;

a notch 47 provided on the ring 25, said notch 47 being capable of snap-fitting on the boss 46 to retain the ring 25 and the lock ring 30 in an angular position in which the fins 34 are each engaged in their respective bayonet 7.

In the example shown, the resilient boss 46 is in the form of a ball mounted on a resilient support (for example, a slide axially translationally mounted on a hole 48 provided in the track 4, with interposing of a return spring).

Figure 13:
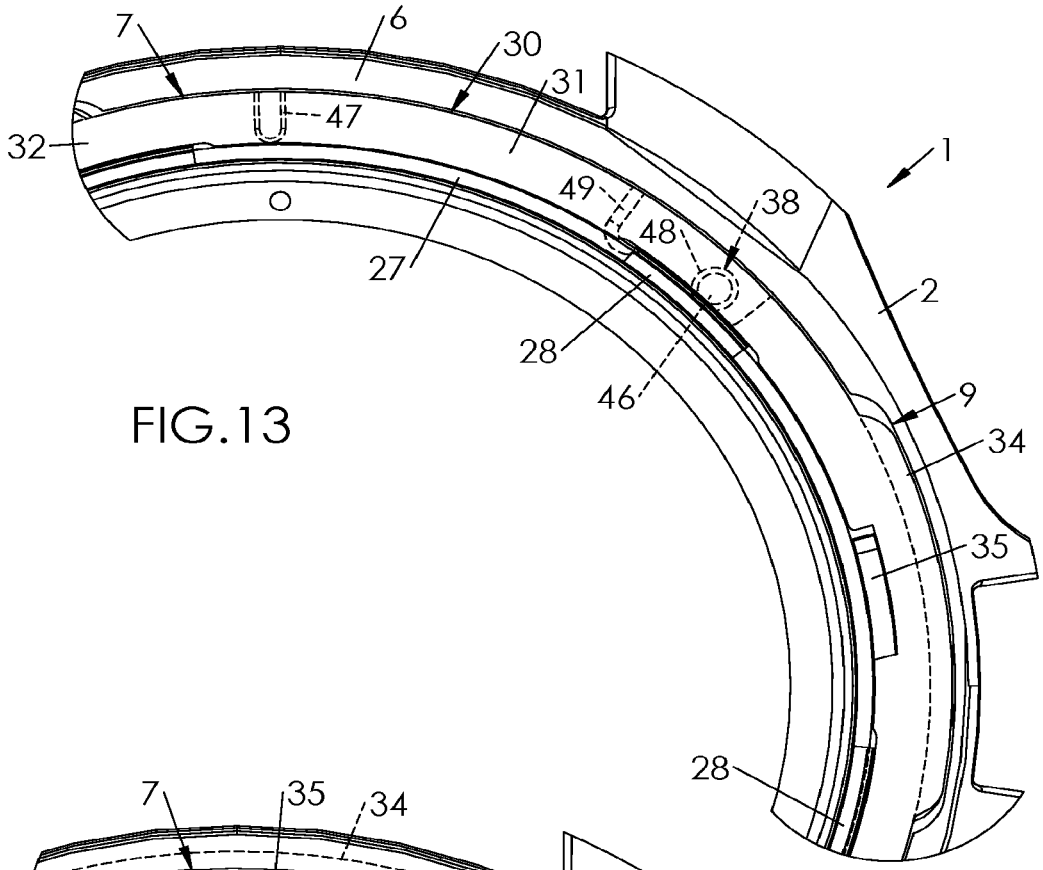
FIG. 13 is a partial top view of the watch case of FIG. 12.
Figure 14:
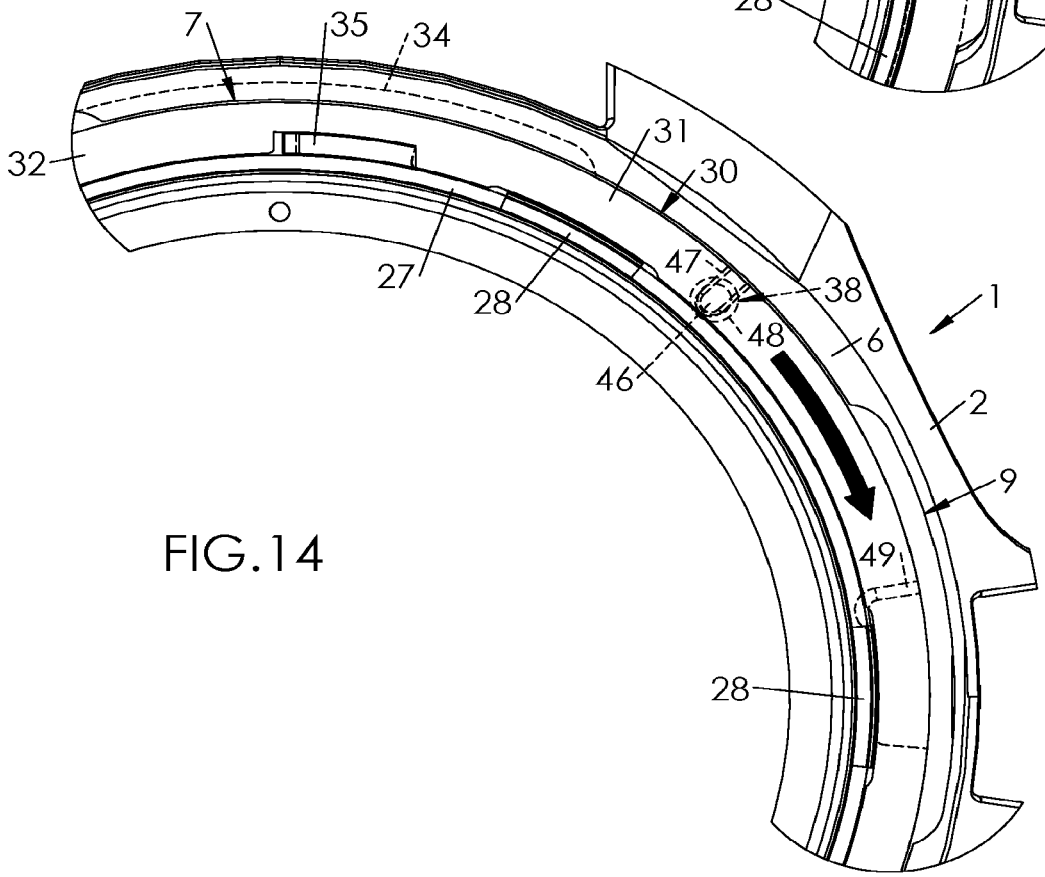
FIG. 14 is a view similar to FIG. 13, showing the watch case in another position.

In this second embodiment, the ring 25 advantageously is provided, in addition to the notch 47, which is wedged on the ball 46 in the locked position (FIG. 14), with a larger recess 49 and which positions itself around the ball 46 during the axial translation movement that accompanies the combined fastening of the lock ring 30 and of the ring on the middle 2 (FIG. 13).

The recess 49 is angularly offset from the notch 47 by an angle substantially corresponding to the angular extension of a bayonet 7.

By way of a variation, or of an addition, the locking mechanism 38 can comprise pawl springs, provided to radially project on a peripheral edge of the lock ring 30 (and, more specifically, of the band 31), and capable of engaging by snap-fitting with hollow indentations radially formed in the middle.

Fifthly, the watch case 1 comprises, a system SC for coupling the bezel 14 to the fastening structure SF. This coupling system SC comprises a male part 50 and a female part 51:

one of which parts (the male part 50 or the female part 51) is integral with the bezel 14;

the other one of which parts (the female part 51 or, respectively, the male parts 50) is integral with the fastening structure SF.

This coupling system SC is arranged to adopt two configurations:

a decoupling configuration, in which the male part 50 and the female part 51 are decoupled, thus rotationally releasing the bezel 14 relative to the band 31;

a coupling configuration, in which the male part 50 and the female part 51 are coupled, thus rotationally securing the bezel 14 and the band 31 and enabling their combined bidirectional rotation between a closed angular position, in which each fin 34 is engaged in a bayonet 7, and an open angular position, in which each fin 34 is disengaged from the bayonet 7.

The bezel 14 is, for its part, mounted on the fastening structure SF with the possibility of axial clearance between:

a deployed position, in which the coupling system SC is placed in a decoupling position; and a retracted position, in which the coupling system SC is placed in a coupling position.

In the examples shown, the male part 50 of the coupling system SC is integral with the bezel, whereas the female part 51 is integral with the fastening structure SF.

More specifically, in the examples shown, the male part 50 is in the form of a pin that projects from the lower face 18 of the bezel 14.

Advantageously, the pin 50 is an added part. In this case, the pin is press-fitted into a hole 52 provided in the bezel 14 and emerging on the side of its lower face 18 (see the detailed view on the top left-hand side of FIG. 2).

Figure 12:
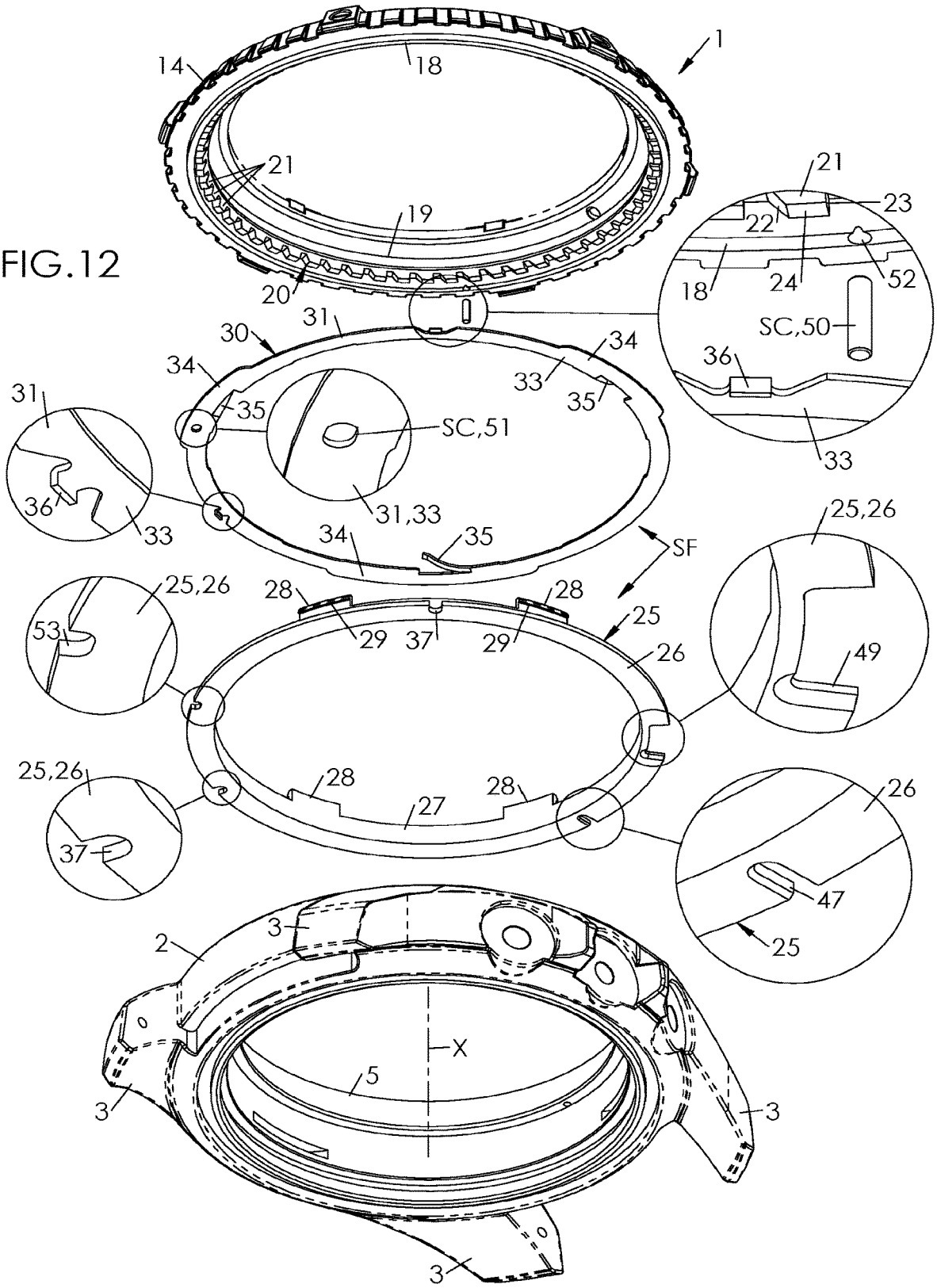
FIG. 12 is a partial exploded perspective bottom view of the watch case of FIG. 11.

A single pin 50 can be provided, as in the example shown in FIG. 11 and FIG. 12. By way of a variation, a plurality of pins can be provided.

As shown in the detailed insets on the top left-hand side of FIG. 1 and FIG. 11, the female part 51 of the coupling system SC is in the form of an opening provided in the lock ring 30. More specifically, this opening 51, with an advantageously closed profile, is provided in the band 31. The female part of the coupling system SC therefore is formed by a recess in the lock ring and, in general, by part of this lock ring forming two stops for the pin, during rotation of the bezel in the retracted position, respectively in the two directions of rotation.

When the coupling system SC comprises a plurality of pins 50, then, correspondingly, it comprises a plurality of openings 51 provided in the lock ring 30.

In the deployed position of the bezel 14 (shown in FIG. 7), the pin 50 is axially separated from the band 31. In these conditions, the coupling system SC is in the decoupling configuration and the bezel can freely rotate relative to the band, the bezel then can be maneuvered by the wearer, for example, to measure a time interval.

In one or more predetermined angular position(s) of the bezel 14 relative to the middle 2, where the (or each) pin 50 is in line with a corresponding opening 51, the bezel can be moved from its retracted position by axially pressing against the pawl spring(s) 35 and, optionally, in the first embodiment of FIG. 1 to FIG. 9, against the leaf spring(s) 39. The pin 50 is then housed in the opening 51 (FIG. 9) to rotationally couple the bezel with the lock ring 30. In these conditions, any rotation of the bezel 14 held in its retracted position is transferred, via the pin, which comes into abutment against the edges of the opening 51, to the band 31 (and therefore to the lock ring 30). In the retracted position of the bezel, the aforementioned coupling allows:

either, in a first direction of rotation, the bezel 14 (with the fastening structure SF) to be disassembled from the middle 2 by disengaging each fin 34 from its bayonet 7;

or, in a second direction of rotation (opposite the first), the bezel 14 (with the fastening system) to be assembled on the middle 2 by engaging each fin 34 in a bayonet 7.

The opening 51 preferably has an angular extension that is equal to or is slightly greater than the diameter of the pin 50. According to a preferred embodiment, the opening 51 is in the form of an oblong hole, which allows a slight angular clearance in the bezel 14 when the pin 50 is housed in the opening, which promotes ease of use. In general, the recess forming the female part of the coupling system advantageously has an angular clearance when the male part is positioned inside this recess.

The ring 25 also, for its part, can be provided, in line with the opening 51 in the lock ring, with a secondary opening 53 capable of receiving an end of the pin 50 (see the detailed insets on the centre-left of FIG. 1 and of FIG. 12).

Figure 10:
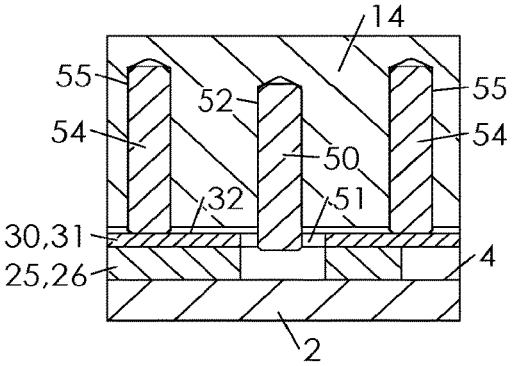
FIG. 10 is a detailed section view along the plane X-X of FIG. 9.

However, it is preferable for the axial clearance of the bezel 14 to be limited, to avoid any excessive deformation of the pawl springs 35 that could possibly damage them. It is for this reason, in a preferred embodiment, that the case 1 comprises one or more stop(s) 54 for limiting the axial travel of the bezel 14. This stop(s) is/are, for example, borne by the bezel 14. Thus, in the example shown in FIG. 2 and FIG. 10, the (or each) stop is in the form of an added pin, press-fitted in an additional hole 55 arranged in the bezel 14 on the side of its lower face 18. The case 1 comprises, for example, at least two stops 54 disposed either side, and in the vicinity of, the (or each) pin 50, as shown in FIG. 10. Each stop is axially located setback from the pin 50, so as to allow the pin to be inserted into the opening 51. Irrespective of the number of pins, it is preferable for a plurality of stops 54 to be provided distributed over the circumference of the bezel 14 in order to distribute the forces.

In the retracted position of the bezel 14, the (or each) stop 54 comes into abutment against the upper face 32 of the band 31 (FIG. 10). It is understood that the axial clearance of the bezel between its deployed position and its retracted position depends on the axial projection formed by each stop 54 on the lower face 18 of the bezel. It is important to ensure that this clearance is large enough to allow the pin 50 to be inserted into the opening 51, whilst being small enough so that compressing the pawl springs 35 does not deform them beyond their elastic limit.

The bezel 14 is mounted on the middle 2 preferably by proceeding as described hereafter.

Firstly, the bezel 14 and the fastening structure SF are assembled. To this end, in the architecture shown, the lock ring 30 is mounted on the ring 25 by threading it on the skirt 27. The hooks 28 pass into the internal opening of the band 31 without difficulty, even less so if it is internally splined level with the hooks. The band 31 comes to rest on the collar 26.

The bezel 14 is then snap-fitted on the ring 25, with the hooks 28 resiliently bending before hooking on the annular rib 19. The lock ring 30 is then sandwiched between the bezel and the ring, the pawl springs 35 engage with the teeth 21 of the crown 20 and exert an axial return force that tends to separate the bezel 14 from the ring 25 and thus keep the notches 29 of the hooks in abutment against the rib 19. In these conditions, the collar 26 is applied against the lower face 33 of the band 31.

The length of the pin 50, and its axial positioning in its hole 52, are such that, even when it is not aligned with the opening 51, it nevertheless allows sufficient axial clearance of the bezel 14 to allow it to be snap-fitted on the ring 25.

Once the bezel 14 and the fastening structure SF are assembled, the sub-assembly that is thus formed can be mounted on the middle 2, by fastening the ring 25 using the aforementioned combined movement: positioning the fins 34 level with the hollows 9, axially translationally moving the sub-assembly (downwards) until the fins are brought into the vicinity of the grooves 8, then rotating the sub-assembly to the angular end of travel position of the lock ring 30, determined:

- in the first embodiment (FIG. 1 to FIG. 9), by snap-fitting the catch 41 in the indentation 45 provided in the middle 2 at the blind end 13 of the bayonet 7, thus rotationally locking the band 31 (and therefore the lock ring 30) relative to the middle 2. This locking is indicated by an audible click accompanying the abrupt return of the lock ring 30, under the return force of the leaf springs 39, until it comes into abutment against the lower face 11 of the groove 8;
- in the second embodiment (FIG. 11 to FIG. 14, with the rotation of the lock ring 30 being shown by the black arrow in FIG. 14), by snap-fitting the ball 46 in the notch 47 provided in the collar 26 (which is also indicated by an audible click when the ball 46, initially axially compressed towards the track 4 by pressing the collar, abruptly returns under the return force of its return spring. When the bezel 14 is released, the return spring of the ball 46 tends to urge the lock ring 30 (as in the first embodiment) against the lower face 11 of the groove 8.

As can be seen in FIG. 7, without axial stress on the bezel 14, the pin 50 is separated from the band 31, such that the bezel can be rotated without entraining the lock ring 30 with it.

Advantageously, the bezel 14 is unidirectional. Given the orientation of the pawl springs 35, the bezel in this case is compelled to rotate (relative to the lock ring 30 and to the ring 25, which remain rotationally secured relative to the middle 2) anti-clockwise. As the ring and the lock ring cannot be seen by the wearer, they only see the rotation of the bezel 14 relative to the middle 2.

An activity (for example, a scuba diving session) is timed as follows. The wearer pivots the bezel 14 until the zero index 17 is brought in line with the minute hand. It is to be noted that, with the pin 50 being separated from the upper face 32 of the lock ring 30, it by no means hinders the rotation of the bezel.

When the wearer releases the bezel 14, the bezel is kept in this position (which is a stable balanced position as long as no rotation movement is communicated thereto) by the pawl springs 35, each of which is then snap-fitted between two successive teeth 21 of the crown 20.

The passage of time causes the minute hand to cover an angular sector on the bezel 14, which allows the wearer to measure the elapsed time on the graduation (for example, ten or fifteen minutes) from the instant at which the positioning of the zero index 17 was performed.

Figure 8:
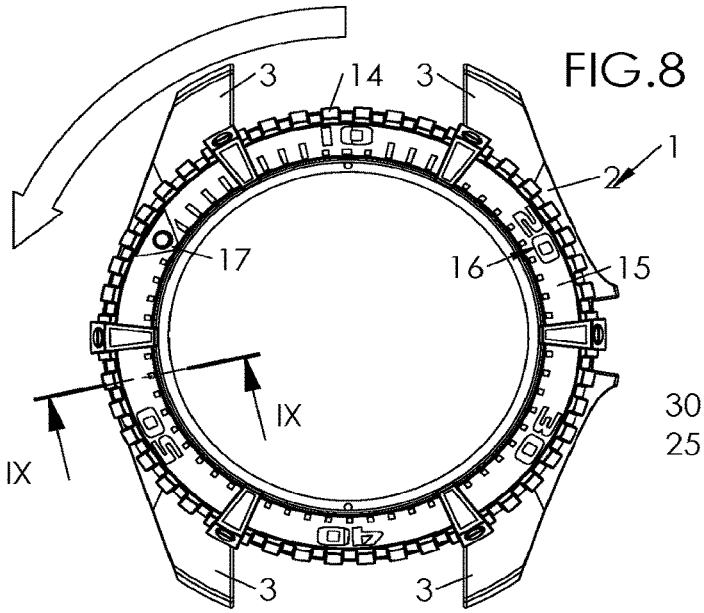
FIG. 8 is a view similar to FIG. 6, where the bezel has been rotated by a predetermined angle in order to bring it to a position that allows it to be unlocked.

In order to disassemble the bezel 14, it should be rotated (anti-clockwise, as allowed by the pawl springs 35) until the pin 50 is in line with the opening 51, as shown by the arc of a circle arrow on the top left-hand side of FIG. 8.

The angular position of the bezel 14 corresponding to the alignment of the pin with the opening 51 can be determined by aligning visual indicators (for example, lines or dots) respectively formed on the bezel and on the middle 2.

Then the bezel 14 should be axially pressed so that it can be forced towards the middle 2 by causing it to transition from its deployed position to its retracted position (as shown by the vertical arrow on the left-hand side of FIG. 9), in order to switch the coupling system SC from its decoupling configuration to its coupling configuration.

More specifically, in the examples shown, the bezel 14 is axially pressed in order to introduce the pin 50 into the opening 51. As long as the bezel remains pressed, the pin is tangentially retained in the opening, which keeps the bezel, the ring 25 and the lock ring 30 rotationally secured.

It is to be noted that, in the first embodiment, axially pressing on the bezel 14 allows the catch 41 to be disengaged from the indentation 45 and thus allows the lock ring 30 to be unlocked so that it can be rotationally released relative to the middle 2 and thus allow the bezel to be disassembled.

The bezel 14 then should be pivoted in the opposite direction to that of the rotation completed during the combined movement of fastening the lock ring 30 on the middle 2. In the embodiments shown, where the assembly rotation is performed clockwise, the disassembly rotation is completed anti-clockwise. This is simple and practical since, apart from during assembly, the wearer always rotates the bezel in the same direction:

- during regular use, to adjust the angular position of the zero index 17;
- then to bring the bezel 14 to the angular position for aligning the pin 50 with the opening 51;
- finally, to disassemble the bezel 14 from the middle 2 (with the ring 25, which remains hooked on the bezel, and the lock ring 30 interposed between them).

The sub-assembly that is thus withdrawn then can be set aside and replaced by another sub-assembly comprising a bezel 14 with a different shape and/or colour, depending on the previously described assembly procedure.

Various variations can be contemplated without departing from the scope of the invention. Thus, the structure SF for fastening the bezel can be in the form of a one-piece part. More specifically, it can be contemplated for the ring 25 and the lock ring 30 to be formed from the same part as a single piece. By contrast, the fastening structure SF can comprise a greater number of parts.

Figure 2:
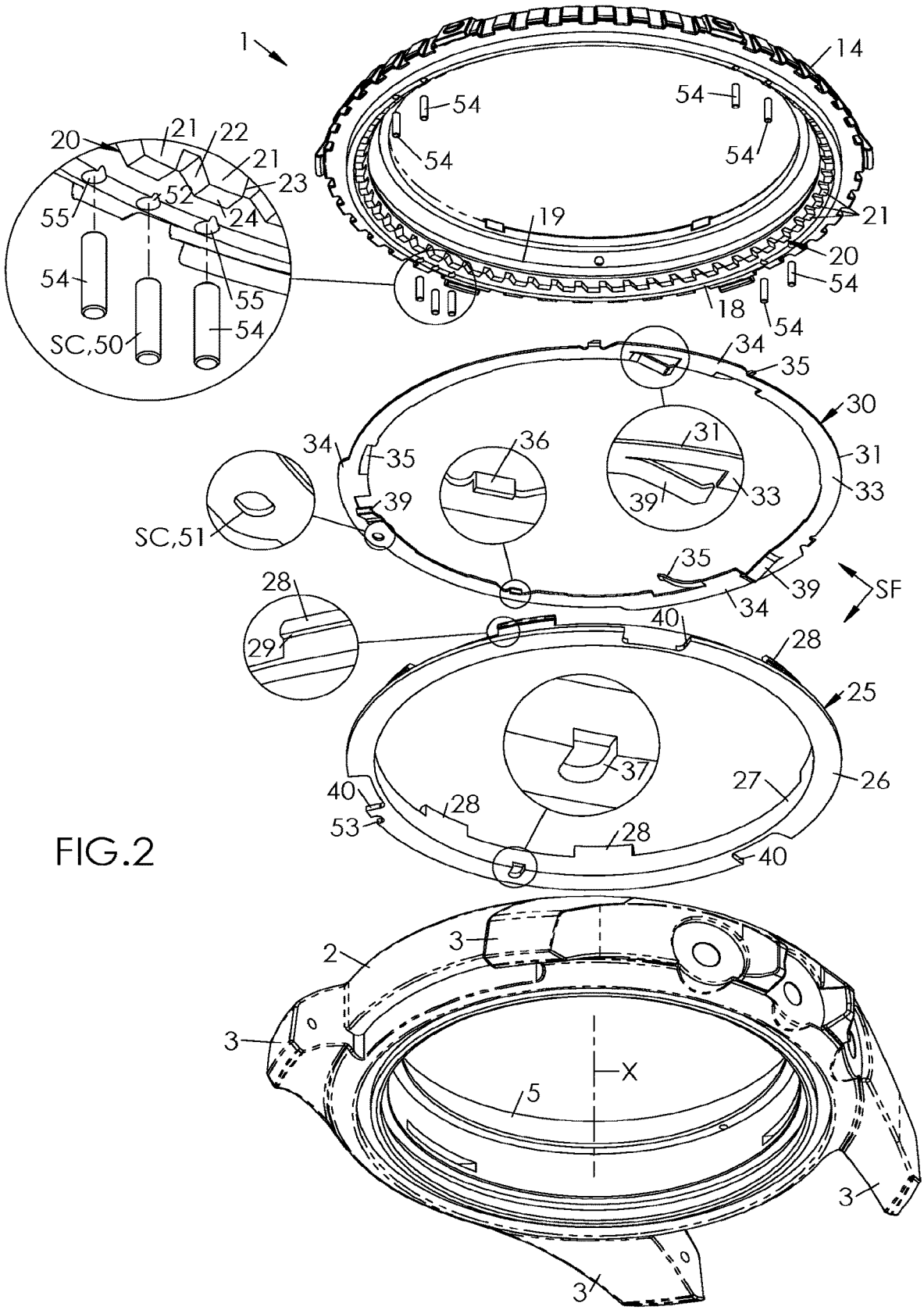
FIG. 2 is a partial exploded perspective bottom view of the watch case of FIG. 1.
Figure 3:
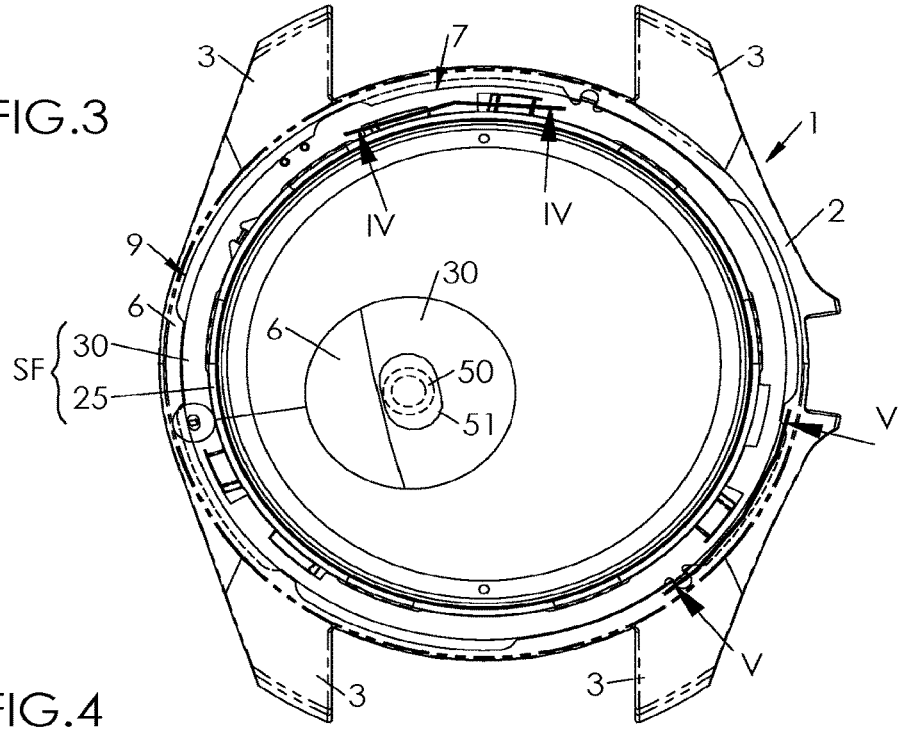
FIG. 3 is a top plan view showing the middle and the fastening system.

Thus, even though it has been seen, in the first embodiment shown in FIG. 2 and FIG. 3, that the leaf springs 39 can be borne by the lock ring 30, in a variation it can be contemplated for such leaf springs to be formed on a separate part, for example, by a retention ring subjacent to the ring 25.

Similarly, if, in the examples shown, the skirt 27 is integrated in the ring 25, it can be contemplated, in a variation, for it to be in the form of a distinct part, which would form a ring axially securing the bezel 14 to the collar 26. Such securing can be implemented by providing, in the internal machining of the bezel, a groove, in which the hooks 28 are inserted with limited clearance. In particular, in an advantageous variation, the springs 39 can be secured not to the lock ring 30, but to the collar 26, for example, they can be integral with this collar and produced by a cut in said collar. In such a case, the pins 54 forming stops for transmitting an axial force applied on the bezel when it is disassembled, can be omitted without any risk of damaging the pawl springs 35 and the teeth of the toothed crown 20, since this axial force is then directly transmitted from the bezel to the collar bearing the springs 39.

Furthermore, if, in the examples shown, the pawl springs 35 and the fins 34 are formed by the lock ring 30, it can be contemplated, in a variation, for them to be formed by two parts that are separate but are rotationally secured inside the fastening structure SF.

It is to be noted that these latter three variations are not mutually exclusive but can be at least partly combined.

Finally, it is to be noted that the system for detachably fastening a rotating bezel on a middle according to the invention has a particular advantage due to the fact that the bayonets provided in an internal wall of the middle lend themselves not only to receiving a unidirectional or bidirectional rotating bezel, but also a non-rotating bezel provided with fastening fins integral with such a bezel. Therefore, it can be understood that the present invention allows an extensive choice to be provided for a set of bezels capable of being alternatively associated with the middle of the watch case in order to vary its appearance and, when necessary, its functionality.

The invention claimed is:

1. A watch case comprising:

a middle defining a peripheral track;

a rotating bezel;

a toothed crown;

at least one angular indexing member that resiliently engages with the toothed crown to define a plurality of stable angular positions of the bezel relative to the middle;

a structure for detachably fastening the bezel on the middle;

wherein the fastening structure comprises an annular band supporting radially projecting fins, each capable of engaging with a bayonet formed in the middle;

and wherein the watch case comprises a coupling system comprising a male part and a female part, one of which is integral with the bezel and the other one of which is integral with the fastening structure, with said coupling system arranged to be able to adopt two following configurations:

a decoupling configuration, wherein the male part and the female part are decoupled, thus rotationally releasing the bezel relative to the annular band;

a coupling configuration, wherein the male part and the female part are coupled, thus rotationally securing the bezel and the annular band and allowing their combined bidirectional rotation between a closed angular position of the annular band, wherein each fin is engaged in a corresponding bayonet, and an open angular position, wherein each fin is disengaged from the corresponding bayonet so as to release the bezel and the annular band from the middle;

the bezel is mounted on the fastening structure with the possibility of axial clearance, when the bezel is mounted on the middle with the annular band in its closed angular position, between:

a deployed position, wherein the coupling system is placed in a decoupling position and the bezel is capable of rotating in order to be placed in any one of the positions of the plurality of stable angular positions;

a retracted position, wherein the coupling system is placed in a coupling position.

2. The watch case according to claim 1, wherein the fastening structure comprises a ring provided with a collar and at least one hook for fastening to the bezel, and a lock ring that comprises the annular band and is interposed between the bezel and the ring.

3. The watch case according to claim 2, wherein the lock ring comprises at least one pawl spring that projects from an upper face of the annular band to form an angular indexing member engaging with the toothed crown.

4. The watch case according to claim 2, wherein the bayonet comprises a groove provided in a rim of the middle, and a hollow, wherein the groove tangentially emerges.

5. The watch case according to claim 4, wherein each groove ends tangentially, opposite the hollow, with a blind end.

6. The watch case according to claim 2, wherein the ring is provided with a cut and the lock ring is provided with a projecting claw, matching the cut and housed therein in order to rotationally secure the ring and the lock ring.

7. The watch case according to claim 2, wherein the ring comprises a peripheral series of hooks.

8. The watch case according to claim 2, wherein the lock ring is provided with leaf springs that project from a lower face of the annular band in order to be applied against the annular track of the middle and thus urge the fins against an upper face of their respective bayonet.

9. A watch equipped with a watch case according to claim 8.

10. The watch case according to claim 2, wherein the lock ring is provided with at least one catch that is capable of snap-fitting in an indentation of the middle in order to lock the lock ring and thus the annular band in its closed angular position.

11. The watch case according to claim 10, wherein the catch is provided adjacent to a fin and the indentation is arranged at a blind end of a bayonet.

12. A watch equipped with a watch case according to claim 10.

13. A watch equipped with a watch case according to claim 2.

14. The watch case according to claim 1, wherein the male part of the coupling system is a pin integral with the bezel and which projects from a lower face thereof, and the female part is a recess, in particular an opening formed in the annular band, capable of, at least in a predetermined angular position of the bezel, receiving the pin in the retracted position of the bezel when this bezel is mounted on the middle through the fastening structure.

15. The watch case according to claim 14, wherein the pin is an added part press-fitted into a hole provided in the bezel and emerging on the side of its lower face.

16. The watch case according to claim 14, wherein the recess has some angular clearance for the pin when said pin is housed therein, in particular the opening is in the form of an oblong hole allowing a slight angular clearance in the bezel when the pin is housed in said oblong hole.

17. The watch case according to claim 2, wherein the middle is provided with a resilient boss that projects from the track, and wherein the ring is provided with a notch capable of snap-fitting on the boss in order to retain the ring and the lock ring in an angular position wherein the fins are engaged in their respective bayonets.

18. A watch equipped with a watch case according to claim 17.

19. The watch case according to claim 1, wherein the crown is integrally formed with the bezel.

20. A watch equipped with a watch case according to claim 1.

* * * * *